United States Patent [19]

Ballway

[11] Patent Number: 4,928,848

[45] Date of Patent: May 29, 1990

[54] COMBINATION DRINKING VESSEL AND CUP HOLDER WITH CONVERTIBLE CAP/COASTER

[76] Inventor: John A. Ballway, 93 North Stoughton Street, Bergenfield, N.J. 07621

[21] Appl. No.: 326,157

[22] Filed: Mar. 20, 1989

[51] Int. Cl.[5] ..... A47G 19/22; A47G 23/02; A47G 23/03; A41J 41/00

[52] U.S. Cl. ..... 220/444; 220/85 H; 220/90.2; 220/903; 215/12.1; 215/13.1; 215/228; 215/229; 229/1.5 H; 229/103.1; 229/906.1

[58] Field of Search ..... 220/85 H, 90.2, 425, 220/903, 444; 215/12.1, 12.2, 13.1, 100.5, 228, 227, 1 A, 229; D 7/70, 77, 9; 229/1.5 H, 906.1, 103.1; 248/146, 346.1

[56] References Cited

U.S. PATENT DOCUMENTS

| | | | |
|---|---|---|---|
| D. 229,153 | 11/1973 | Moussette | D7/70 |
| D. 229,156 | 11/1973 | Moussette | D7/70 |
| D. 230,239 | 2/1974 | Dodge | D 7/9 |
| D. 286,967 | 12/1986 | Appel | D 7/9 |
| D. 290,571 | 6/1987 | Rowe | D 7/70 |
| 1,334,342 | 3/1920 | Woods | 220/85 H |
| 1,389,594 | 9/1921 | Moore . | |
| 2,329,512 | 9/1943 | Clifford, Jr. | 215/100.5 |
| 2,509,133 | 5/1950 | Carew | 229/1.5 H X |
| 2,661,898 | 12/1953 | Phinney | 229/906.1 X |
| 2,782,616 | 2/1967 | Eron | 229/1.5 H X |
| 2,895,636 | 7/1959 | Martin | 215/12.1 X |
| 2,909,300 | 10/1959 | Engram | 215/12.1 |
| 3,013,691 | 12/1961 | Prentice | 220/85 H |
| 3,107,028 | 10/1963 | DeRobertis | 220/25 H X |
| 3,232,512 | 2/1966 | Wanderer | 229/1.5 H |
| 3,302,427 | 2/1967 | Stoner et al. | 220/903 X |
| 3,337,109 | 8/1967 | Shumrak | 229/1.5 H |
| 3,350,131 | 10/1967 | Tanzer | 215/100.5 X |
| 3,473,682 | 10/1969 | Studen | 215/12.1 |
| 3,596,795 | 8/1971 | Ercoli | 220/85 H X |
| 3,765,559 | 10/1973 | Sauey et al. | 215/12.1 X |
| 3,766,975 | 10/1973 | Todd | 215/12.1 X |
| 3,804,281 | 4/1974 | Eckdahl | 215/12.1 |
| 4,111,303 | 9/1978 | Compton | 206/520 |
| 4,124,120 | 11/1978 | Day | 206/519 |
| 4,441,623 | 4/1984 | Antoniak | 229/906.1 X |
| 4,467,934 | 8/1984 | Hummer | 220/85 H |
| 4,610,351 | 9/1986 | Coles, et al. | 206/217 |
| 4,648,525 | 3/1987 | Henderson | 220/85 H |
| 4,681,239 | 7/1987 | Manns et al. | 220/408 |
| 4,720,023 | 1/1988 | Jeff | 220/412 |

FOREIGN PATENT DOCUMENTS

| | | | |
|---|---|---|---|
| 1397877 | 6/1975 | United Kingdom | 220/425 |

*Primary Examiner*—Sue A. Weaver
*Attorney, Agent, or Firm*—Kenneth Watov; David Jackson; Stefan Klauber

[57] ABSTRACT

A combination drinking vessel, and cup holder includes a cylindrically shaped outer container enclosing a truncated conically shaped inner container, the inner container being for holding fluid or for holding a drinking cup with the lip thereof juxtaposed to a rolled over lip about the mouth of the outer container; a rolled over lip being provided about the bottom of the outer container; a cap serving as a cover by snapping over the lip at the mouth of the outer container, or as a coaster by snapping over the lip at the bottom of the outer container; inserts for placement within the inner container for accommodating different size cups therein; and thermal insulation filling the space within said outer container not occupied by the inner container.

22 Claims, 6 Drawing Sheets

COMBINATION DRINKING VESSEL AND CUP HOLDER WITH CONVERTIBLE CAP/COASTER

FIELD OF THE INVENTION

The field of the present invention relates generally to drinking vessels, and more particularly to such vessels serving as containers for holding other drinking vessels such as cups.

BACKGROUND OF THE INVENTION

There are many examples in the prior art of various holders for beverage cans, paper cups, coffee cups, and so forth. A number of these prior references are discussed below.

Mousett, Design Patent Nos. Des. 229,153 and Des. 229,156, each show beverage can holders that are shaped to appear as beer mugs.

Moore, U.S. No. 1,389,594, discloses a paper cup holder having a truncated cone-like shape for receiving a substantial lower portion of a paper cup, whereby the paper cup is nestled within the holder and rests against the bottom of the latter. The holder is provided with a finger handle.

Prentice. U.S. No. 3,013,691 discloses a holder for beverage cans. The holder has a mug-like appearance, and is double walled in order to provide dead air spaces for thermally insulating a beverage can contained within the holder from ambient temperatures.

Studen, U.S. No. 3,473,682 discloses an insulated jacket of unicellular expanded polyethylene foam that is tubularly shaped and dimensioned for fitting snugly about a substantial portion of the lower portions of a drinking utensil, such as a cup or tumbler. The jacket may also serve as a coaster.

D'Ercoli, U.S. No. 3,596,795 discloses a reusable cup holder of truncated conical shape, and including a series of circumferential locking rings or ribs or grooves successively arranged about an uppermost portion of the interior wall of the holder, for mating with similar rings or grooves on a drinking cup placed within the holder, in order to better secure the cup within the holder. A protruding finger handle is provided on the holder.

Compton, U.S. No. 4,111,303 discloses a plastic nestable container having side walls diverging from top to bottom, and shoulder-like projections on the upper and lower portions of the outside of the container, for permitting easy nesting of the container or cups for purposes of shipment, storage, and disbursement. In this manner, separation of the cups is also resisted. A similar design for a cup is disclosed in Dav. U.S. No. 4,124,120.

Coles, et al., U.S. No. 4,610,351 shows an insulated drinking cup of thermoplastic material. The mouth of the cup includes a wall portion that is turned over and downward to form an extending collar about the mouth. The collar extends circumjacent the upper inner portion of the cup, for providing a user with a holding collar that is substantially insulated from the inner wall of the cup, preventing the collar from becoming hot when hot beverages are contained within the cup.

Henderson, U.S. No. 4,648,525 teaches a one piece beverage insulator holder having an open top, and support base formed from an insulative foam material. The holder is dimensioned to fit snugly about a substantial portion of a beverage container.

Manns, U.S. No. 4,681,239 discloses another form of holder for containers. The holder includes an elongated, annular, sidewall and a bottom portion for forming a cylindrical interior portion for snugly fitting about a container to be held therein. A rim is provided on the outer surface of the annular sidewall.

Jeff, U.S. No. 4,720,023 discloses an insulated mug and beverage can holder consisting of a one-piece flexible ring-shaped retainer with an annular groove mounted on an upper rim of the insulated mug. The annular groove includes an outside lip that is slightly inwardly biased, and is slightly smaller in diameter than the outside of the flared or beaded portion of the mug to which it is fastened. The inner edge of the flexible retainer includes inwardly facing tabs, with the diameter of the inner edge being smaller than the diameter of a beverage can to be held within the mug, thereby providing positive retention of the beverage can within the mug. The base of the mug is recessed and similar in size and shape to the top of the mug, for permitting the flexible retainer to be stored on the base of the mug when it is being used as a drinking vessel.

It is known to provide beverage coolers in the form of a drinking mug. For example, a styrofoam cooler shaped in the form of a giant drinking mug is sold by "Promotions Unlimited", of Benton Harbor, Michigan.

SUMMARY OF THE INVENTION

An object of the invention is to provide an improved cup holder.

Another object of the invention is to provide an improved cup holder that can also be itself used as a drinking vessel.

Yet another object of the invention is to provide an improved cup holder with a cap that can also serve as a coaster.

Yet another object of the invention is to provide an improved insulated cup holder, that itself can also be used as a drinking vessel.

Another object of the invention is to provide an improved drinking vessel for containing therein different size drinking cups, while maintaining the lip of the cups at the same level as the lip of the drinking vessel.

With these and other objects in mind, one embodiment of the invention includes a drinking vessel generally shaped as a beer mug, both the uppermost and lowermost portions of the outside wall having an outwardly protruding band-like flange, with the circumference of the mouth of the vessel having a rolled over lip projecting from the topmost portion of the uppermost flange, a similar lip being formed about the bottom of the circumference of the lowermost flange, the outer walls being substantially otherwise cylindrical in shape, a truncated conically shaped container being formed within the interior portion of the vessel, with the uppermost portion of the inner container being rigidly connected to the inside surface of the uppermost portion of the outer walls, with the shape of the inner container being of a dimension for receiving a drinking cup for containment therein. Truncated cone-shaped inserts dimensioned to fit snugly within the lower portion of the inner container of the drinking vessel are provided for permitting different size drinking cups to be contained therein, whereby the upper lips of the different size drinking cups can be maintained adjacent the upper lip of the drinking vessel for permitting a user to drink directly from the cup. A cap includes interior juxtaposed circumferential grooves, whereby the lowermost groove snap locks onto the lip of the drinking vessel; a circumferential rim between the grooves prevents the cap from being pushed further down onto the drinking vessel, and in combination with the space formed by the uppermost groove, prevents crushing of any cups placed within the drinking vessel. The cap also serves as a coaster, when its lowermost groove is snap locked onto a circumferential lip about the bottom of the drinking vessel.

BRIEF DESCRIPTION OF THE DRAWINGS

With reference to the drawings, wherein like items are identified by the same reference designation, the invention will be described with reference thereto, wherein.

DETAILED DESCRIPTION OF THE PREFERRED EMBODIMENTS OF THE INVENTION

Figure 1A:
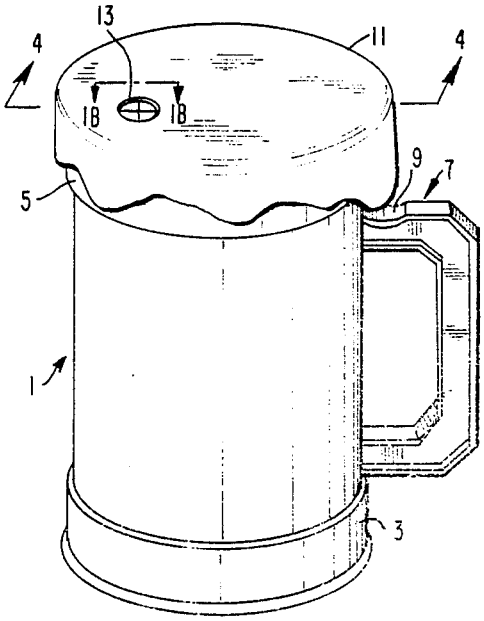
FIG. 1A is a perspective view of one embodiment of the invention.

With reference to FIG. 1A, in a first embodiment of the invention, a drinking vessel 1 is generally shaped as a beer mug, as shown. An outwardly projecting band-like member 3 surrounds the circumferential lowermost portion of vessel 1, and a similar flange member 5 is provided around the circumference of the uppermost outside portion of the vessel 1. A channelized-like handle 7 is also included with a thumb groove 9. A cap 11 is provided as shown, and in this example is shaped to simulate the froth of beer or other carbonated beverages.

Figure 1B:
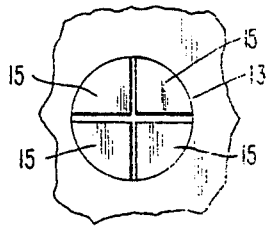
FIG. 1B is an enlarged plan view taken along line 1B—1B of FIG. 1A.

Cap 11 also includes a straw hole 13. As shown in the enlarged plan view of FIG. 1B, four resilient quarter-pie-like flap members 15 substantially close off the straw hole 13 when not in use. The flaps 15 are fabricated from a flexible elastic material having memory, such as plastic.

Figure 2:
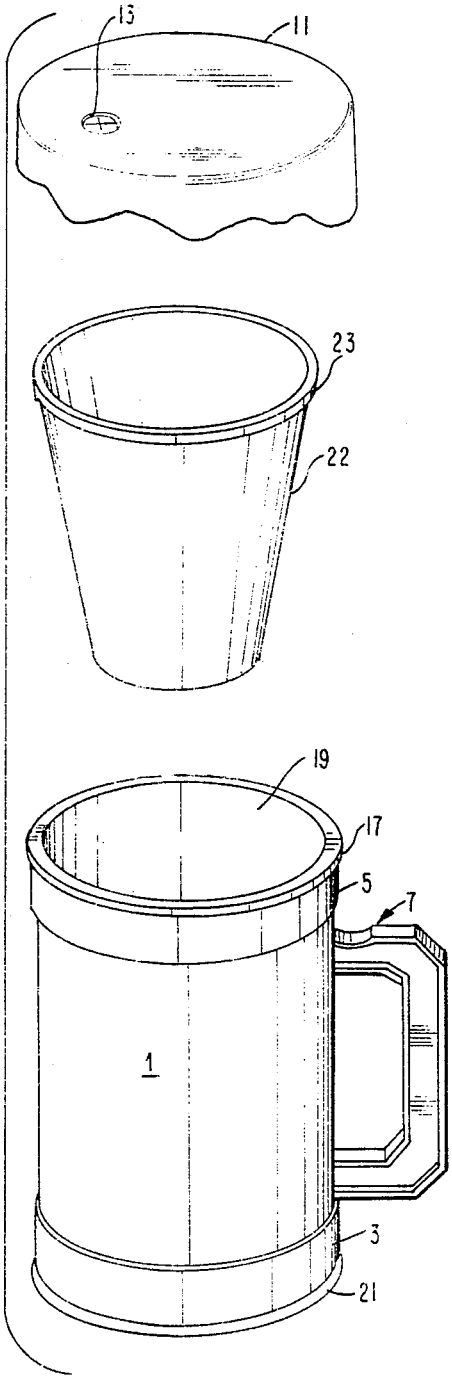
FIG. 2 is an exploded perspective/assembly view of one embodiment of the invention.
Figure 3:
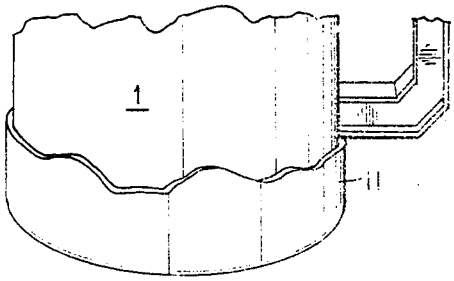
FIG. 3 is a perspective view of an embodiment of the invention showing the dual functioning cap serving as a coaster via attachment to the bottom of the illustrated vessel.

With reference to FIG. 2, the vessel 1 also includes a rolled over lip 17 forming the outer circumferential edge about the opening 19 of vessel 1, immediately proximate and projecting from the top edge of flange 5. A similar lip 21 is provided about the circumference of the bottom of vessel 1 immediately proximate and protruding from the lower edge of the band-like flange 3. As will be described in further detail below, the interior portion of the vessel 1 is shaped for snugly receiving a cup 22, such as a paper cup for example, whereby the lip 23 of the cup 22 typically is adjacent to and at the same level as the lip 17 at the opening of vessel 1 when cup 22 is contained therein. As will be described in greater detail below, the cap 11 is designed to include two circumferential juxtaposed grooves about its interior side walls for permitting cap 11 to snap over the top of vessel 1, and be secured thereto via captive retention of the lip 17 within the lowermost interior groove of cap 11. In a similar manner, as shown in FIG. 3, the cap 11 is made to serve a dual function as a coaster by snapping the same over the bottom of vessel 1, where it is retained thereto via lip 21 being held captive in the lowermost interior groove of cap/coaster 11.

Figure 4:
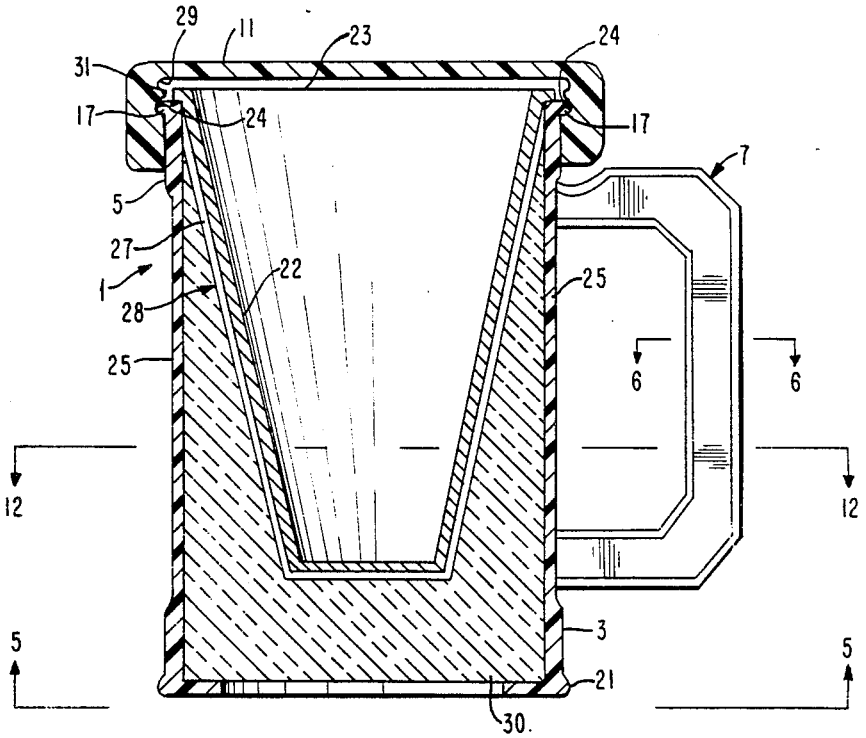
FIG. 4 is a sectional view of the embodiment of FIG. 1A taken along line 4—4 thereof.

FIG. 4 more clearly shows the coupling of cap 11 to the top of vessel 1. As shown, cap 11 includes interior lower and upper circumferential grooves 24 and 29, respectively, whereby the lowermost groove 24 snaps over and locks onto lip 17 of vessel 1. In this manner cap 11 is secured to the top of vessel 1. Also, the circumferential protruding rib 31 formed between and separating grooves 24 and 29, prevents cap 11 from being pushed further onto vessel thereby preventing crushing of the lip of a cup 22 placed in container 27 (described below). Also, the upper groove space 29 of cap 11 is dimensioned to be wider than the lip 23 of a typical cup 22, in order to further protect the lip 23 from being crushed by a user pushing down on cap 11, when seated upon the top of a vessel 1, as shown. The cap 11 is fabricated from a resilient and elastic material having memory, such as polypropylene, or other suitable material.

In this embodiment, the vessel 1 is also fabricated from polypropylene, or some other suitable plastic or other material. The outer walls or container 25 serve as a housing and support for an interior truncated conically shaped container 28 rigidly mounted to the upper surface of the wall members 25. The walls 27 of container 28 can be fabricated in a single piece along with other portions of vessel 1, or can be fabricated separately and secured to the uppermost inside circumferential portion of the inner cylindrical surfaces of wall 25 via an appropriate epoxy, electronic welding, and so forth. Also, in this embodiment the space between the walls 27 of interior container 28 and drinking vessel walls 25 is filled with a thermal insulating material 30, such as styrofoam, or some other open-celled foam material, or other suitable thermal insulating material, for example. In this manner, through the use of insulated material 30, hot or cold beverages held within container 28 (with or without cup 22) can be stored for longer periods within vessel 1 over which the desired temperature is substantially retained.

Figure 5:
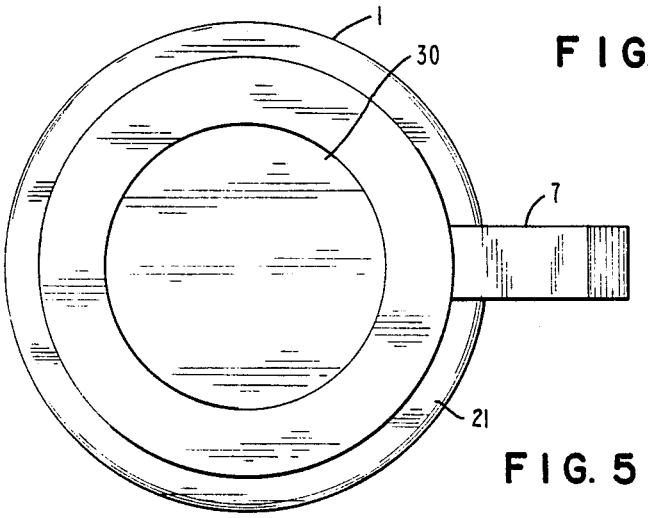
FIG. 5 is a bottom plan view taken along line 5—5 of FIG. 4.

In FIG. 5, the bottom of the vessel 1 of the embodiment of FIG. 4 is shown. As illustrated, the bottom of vessel 1 includes an outer ring-like portion 21, filled with insulating material 30.

Figure 6:
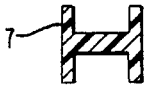
FIG. 6 is a cross-sectional view taken along line 6—6 of FIG. 4.

As previously mentioned, the handle 7 is fabricated to provide a channel-like shape. In FIG. 6, a cross-sectional view taken along line 6—6 of FIG. 4 shows the general cross-sectional shape of handle 7. In this manner, a better grip can be maintained on the handle.

Figure 7:
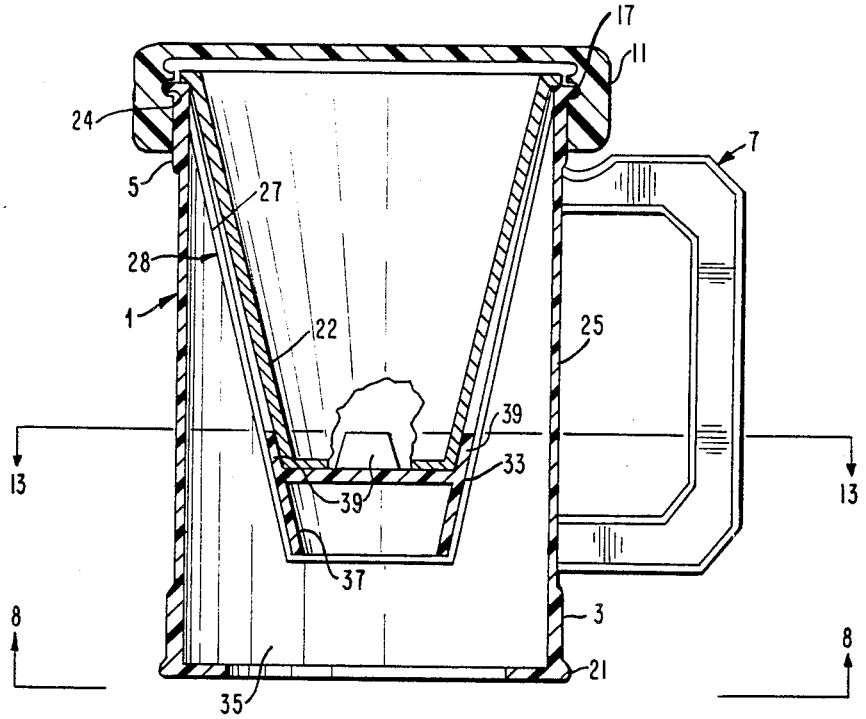
FIG. 7 is a longitudinal sectional view of the embodiment of FIG. 1A showing an alternative interior embodiment of the invention relative to the embodiment of FIG. 4, the latter being uninsulated, whereas the former is insulated.

In FIG. 7, a longitudinal view of a cross-section of the vessel 1 of FIG. 1A is shown for an alternative embodiment of the invention for providing a less expensive substantially uninsulated drinking vessel 1, that otherwise is substantially similar to the embodiment of FIG. 4. Also, as shown in FIG. 7, yet another embodiment includes an insert member 33 positioned as shown within container 28 (the former will be described in greater detail below). The insert member 33 permits a smaller or shorter cup 22 to be contained within container 28, while maintaining the top lip 23 of the cup 22 at the same level as the top lip 17 of vessel 1. Accordingly, through the use of different heights for inserts 33, container 28 can be readily adapted for receiving a plurality of different size cups 22 in a manner permitting the lips 23 of the cups 22 to be adjacent lip 17 of vessel 1. For example, container 28 may be dimensioned for receiving a 20-ounce cup 22 in a manner as shown in the embodiment of FIG. 4. To accommodate a smaller cup 22, such as a 16 ounce cup 22, insert 33 is used as shown in FIG. 7.

Figure 8:
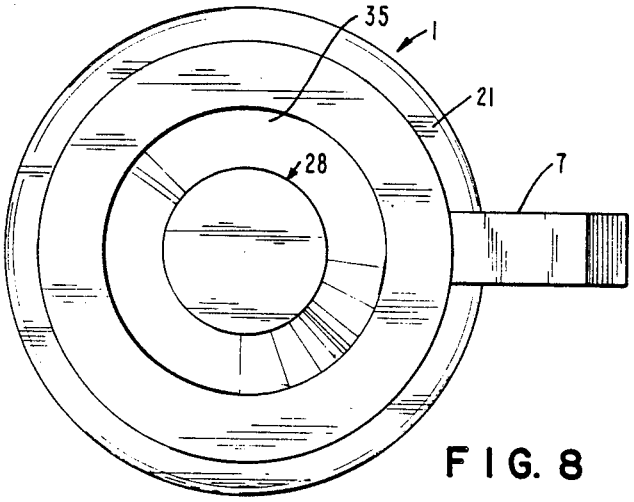
FIG. 8 is a bottom plan view taken along line 8—8 of FIG. 7.

In FIG. 8, a plan view of the bottom of vessel 1 as viewed along line 8—8 is shown. Note that air is in the open space 35 between the outside of wall 27 of container 28 and the inside surface of wall 25 of vessel 1, in this embodiment.

Figure 9:
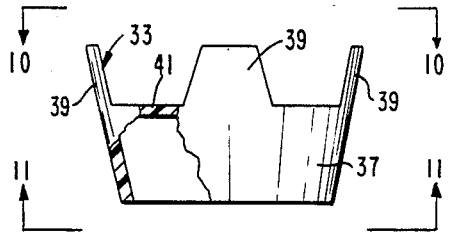
FIG. 9 is a breakaway side-elevation view of an insert embodiment of the present invention.
Figure 10:
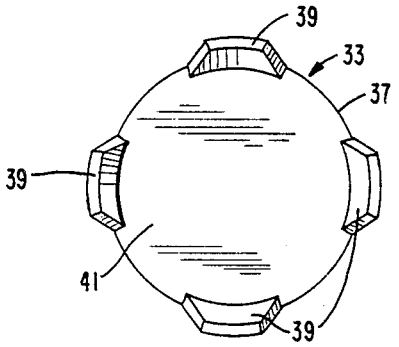
FIG. 10 is a top plan view taken along line 10—10 of the embodiment of FIG. 9.
Figure 11:
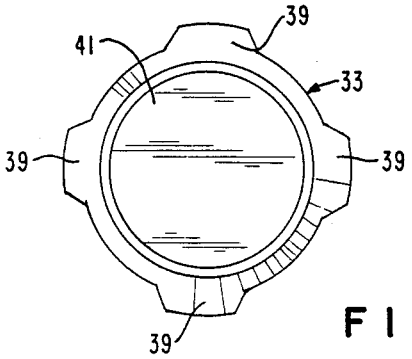
FIG. 11 is a bottom plan view taken along line 11—11 of the embodiment of FIG. 9.

In FIG. 9, a breakaway side elevation view of insert 33 is shown. The insert 33 has a truncated conical shaped lower portion 37. Four upwardly projecting tabs 39 are evenly spaced about the upper edge of lower portion 37, as shown in FIG. 10. Note that FIG. 10 is a top view of insert 33 taken along line 10—10 of FIG. 9. A bottom view of insert 33 taken along line 11—11 of FIG. 9 is shown in FIG. 11. Note that insert 33 includes a substantially centrally located circularly shaped surface or platform 41.

Figure 12:
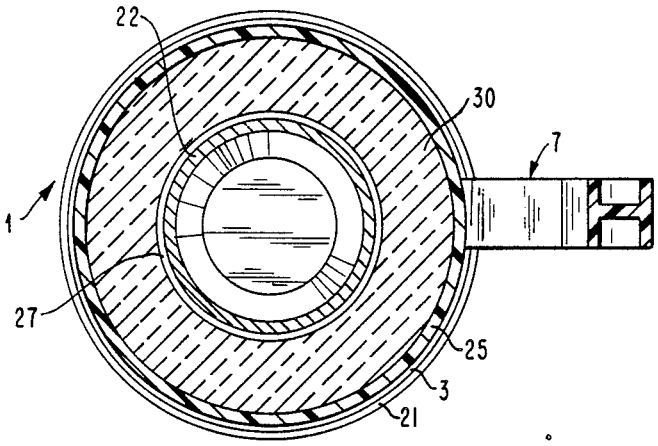
FIG. 12 is a cross-sectional view taken along line 12—12 of FIG. 4.
Figure 13:
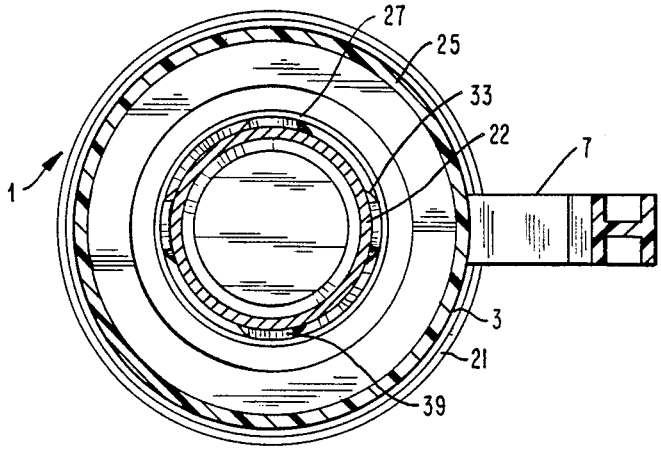
FIG. 13 is a cross-sectional view taken along line 13—13 of FIG. 7.

In FIG. 12, a cross-sectional view taken along line 12—12 of the embodiment of FIG. 4 is shown. Note that in this example, the large cup 22 fits snugly within container 28. Contrarywise, in the cross-sectional view of FIG. 13, the smaller cup 22 fits snugly at its lowermost portion within tabs 39 of insert 33, which also serves to secure cup 22 within container 28, when its size otherwise does not fit snugly therein, for example.

Figure 14:
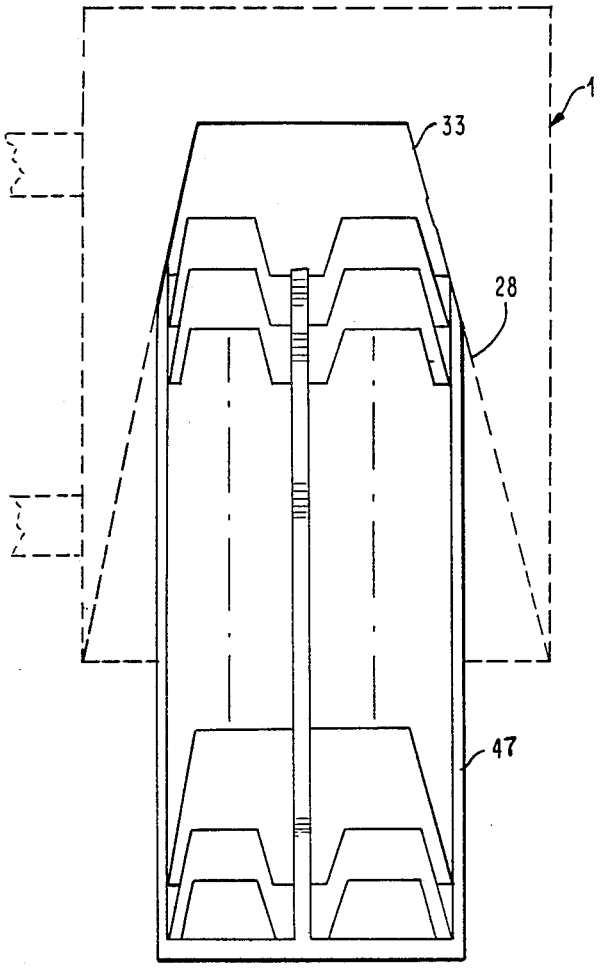
FIG. 14 is a side elevational view of another embodiment of the invention providing for stacking of inserts.
Figure 15:
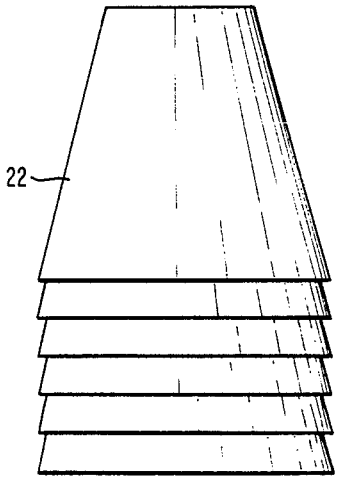
FIG. 15 is a side elevational view of a stack of cups.

The inserts 33 can be used in either of the embodiments of the invention shown in FIG. 4, and in FIG. 7, respectively. In FIG. 14, a side elevational view of a holder or stacking device 41, for permitting orderly stacking of inserts 33 is shown. Appropriate spring biasing of other automatic feeding means (not shown) can be incorporated in the holder 47 for insuring that a next available insert 33 is thrust upward and substantially clear of the holder 47. In this manner, a vessel 1 can be dropped on top of the uppermost one of the inserts 33 carried by holder 47, for quickly inserting an insert 33 into the container 28 of vessel 1. Similarly, by stacking a plurality of cups 22 as shown in FIG. 15, a vessel 1 can be dropped over the outermost one of the stacked cups 22, for substantially securing a cup 22 within a container 28 via the frictional contact either between the interior surface of walls 27 of container 28 and outside surface of cups 22, or between the latter and the inner surface at tabs 39 of inserts 33, depending upon the size of the cups 22, for example.

Although various embodiments of the invention have been shown and described herein for purposes of illustration, other embodiments and variations thereof may occur to one of ordinary skill in the art, that are intended to be covered by the spirit and scope of the appended claims. For example, inserts 33 can also be provided for permitting beverage cans to be contained within container 28. Also, the outer container 25 and inner container 28 can be shaped differently than illustrated herein.

What I claim is:

1. A combination drinking vessel and cup holder comprising:

an outer container having an open top portion; and an inner container having downwardly converging side walls terminating at a closed bottom, the outside uppermost circumferential wall portion thereof being rigidly attached to the topmost circumferential inside wall portion of said outer container, for containing fluid or a relatively large drinking cup dimensioned to be received snugly therein, so that the lip of said cup is juxtaposed to a top lip of said outer container.

2. The vessel of claim further including a handle rigidly attached to the outside wall of said outer container.

3. The vessel of claim 1, wherein said outer container is substantially cylindrically shaped, and has both an open top and an open bottom.

4. The vessel of claim 1, wherein said outer container further includes outwardly projecting from an uppermost circumferential portion of the outside wall thereof, a first band-like flange.

5. The vessel of claim 4, wherein said outer container further includes outwardly projecting from a lowermost circumferential portion of the outside wall thereof, a second band-like flange.

6. The vessel of claim 5, wherein said outer container further includes:

a first rolled over lip forming the topmost circumferential portion of said first flange; and a second rolled over lip forming the lowermost circumferential portion of said second flange.

7. The vessel of claim 6, further including a cap, said cap including snap locking means for permitting said cap to, in one mode of use, serve as a cover by being pushed over the top of said outer container and secured thereto via snap locking with said first lip, and in another mode of use to serve as a coaster by being pushed over the bottom of said outer container, and secured thereto via snap locking with said second lip.

8. The vessel of claim 7, wherein said cap further includes crush prevention means for limiting the extent said cap can be readily pushed down upon the top of said outer container, for preventing crushing of the lip of a drinking cup held within said inner container.

9. The vessel of claim 8, wherein said snap locking means includes a first inner circumferential groove proximate the bottom edge of said cap.

10. The vessel of claim 9, wherein said crush prevention means of said cap includes:

a second inner circumferential groove located above said first groove; and a radially inward projecting circumferential rim located between and separating said first and second grooves, said rim limiting the extent of downward positioning of said cap on said outer container, and said second groove providing space for the top portion of a cup substantially within said inner container, with the topmost portion of the cup being within said cap, when positioned over said vessel.

11. The vessel of claim 1, wherein said inner container is shaped in the form of a truncated cone.

12. The vessel of claim 7, wherein said cap includes straw hole means through its top surface, for permitting a straw to be inserted therethrough partially into said inner container, when said cap is covering said vessel.

13. The vessel of claim 12, Wherein said straw hole means further includes sealing means for substantially closing off said straw hole means whenever a straw is not inserted therethrough.

14. The vessel of claim 1, further including insert means dimensioned to fit snugly within a lower portion of said inner container at a predetermined level relative to a given size drinking cup, for permitting this size cup to have its lip juxtaposed to said first lip, when said cup is within said inner container, thereby facilitating the containment of different size drinking cups within said inner container with easy drinking therefrom.

15. The vessel of claim 14, wherein said insert means include a base for receiving the bottom of a drinking cup, downwardly converging side walls from said base, and a plurality of upwardly projecting tabs between which the bottom portion of an associated cup can be snugly nested, for substantially securing said cup within said inner container.

16. The drinking vessel of claim 1, wherein a space is defined between said inner and outer containers, and further including thermal insulating material filling the space within said outer container not occupied by said inner container.

17. The drinking vessel of claim 1, wherein said vessel is fabricated from a suitable plastic material.

18. The drinking vessel of claim 1, wherein said vessel is fabricated from polypropylene.

19. The drinking vessel of claim 2, wherein said handle has horizontal and vertical cross-sections that are "H" shaped.

20. The drinking vessel of claim 7, wherein said cap has side portions shaped to simulate foam dripping over the top of said outer container when covered by said cap.

21. The drinking vessel of claim 2, wherein said outer container is shaped to appear as a beer mug.

22. A drinking vessel providing for both drinking directly therefrom, or use as a cup holder, comprising:

a cylindrically shaped outer container having an open top, and an open bottom;

outwardly projecting first and second band-like flanges about the upper most and lowermost portions of the outside wall of said outer container, respectively;

a first rolled over lip projecting from the topmost portion of the first flange;

a second rolled over lip projecting from the lowermost portion of said second flange;

a truncated conically shaped inner container having downwardly converging side wall terminating at a closed bottom, the outside uppermost circumferential wall portion thereof being rigidly attached to the topmost circumferential inside wall portion of such outer container;

said inner container serving to either contain fluid, or a relatively large drinking cup dimensioned to be received snugly therein, so that the lip of said cup is juxtaposed to said first lip of said outer container;

a handle rigidly attached to the outside wall of said outer container;

a cap including interior juxtaposed uppermost and lowermost juxtaposed circumferential grooves, separated by a circumferential rim therebetween, said lowermost groove serving to snap lock onto said first lip for securing said cap to the top of said outer container, said rim limiting the extent said cap can be pushed downupon the top of said outer container, the combination of said rim, and the area provided by said uppermost groove, protecting a lip or top portion of a cup held within said inner container;

said cap serving as a coaster via said lowermost groove being snap locked over said second lip, for securing said cap to the bottom of said outer container;

said cap including on its top surface a through hole for receiving a straw therethrough into said inner container, and sealing means for effectively sealing said through hole when not in use;

truncated cone-shaped inserts dimensioned to fit snugly within a lower portion of said inner container at a predetermined level relative to a relatively smaller drinking cup, for permitting said smaller drinking cup to be contained within said inner container, with a lip of said drinking cup juxtaposed to said first lip, thereby permitting different size drinking cups to be stored within said inner container in a manner facilitating direct drinking therefrom, said inserts including a plurality of upwardly projecting tabs evenly spaced about the circumference of said inserts for snugly receiving the lower portion of a cup therebetween, with the bottom of said cup resting on a bottom of said insert; and thermal insulating material filling the space within said outer container not occupied by said inner container, for maintaining fluids kept in said inner container at a given temperature for extended periods of time.

* * * * *

UNITED STATES PATENT AND TRADEMARK OFFICE

CERTIFICATE OF CORRECTION

PATENT NO. : 4,928,848

DATED : May 29, 1990

INVENTOR(S) : John A. Ballway

It is certified that error appears in the above-identified patent and that said Letters Patent is hereby corrected as shown below:

Claim 2, line 1, before "further" insert --1,--.

Signed and Sealed this

Nineteenth Day of November, 1991

*Attest:*

HARRY F. MANBECK, JR.

*Attesting Officer*

*Commissioner of Patents and Trademarks*